US006089774A

United States Patent [19]

Franken et al.

[11] Patent Number: 6,089,774

[45] Date of Patent: Jul. 18, 2000

[54] REFILLABLE CONTAINER FOR APPLYING A SPREADABLE PRODUCT, MORE PARTICULARLY AN ADHESIVE COMPOUND

[75] Inventors: Joachim Franken, Duesseldorf; Marie-Claude Bossert, Erkrath, both of Germany; Johannes H. J. M. Kelders, Drunen; Roy E. van Swieten, Heusden, both of Netherlands

[73] Assignees: Henkel Kommanditgesellschaft auf Aktien, Duesseldorf, Germany; Henkel Raycap Produktie B.V., Ravenstein, Netherlands

[21] Appl. No.: 08/732,259

[22] PCT Filed: Apr. 18, 1995

[86] PCT No.: PCT/EP95/01435

§ 371 Date: Nov. 27, 1996

§ 102(e) Date: Nov. 27, 1996

[87] PCT Pub. No.: WO95/28857

PCT Pub. Date: Nov. 2, 1995

[30] Foreign Application Priority Data

Apr. 27, 1994 [NL] Netherlands ..... 9400680

[51] Int. Cl.[7] ..... A45D 40/14; A45D 40/06

[52] U.S. Cl. ..... 401/63; 401/68; 401/75; 401/175

[58] Field of Search ..... 401/63, 64, 68, 401/75, 79, DIG. 1, 175

[56] References Cited

U.S. PATENT DOCUMENTS

| | | | |
|---|---|---|---|
| 1,236,878 | 8/1917 | Saluas | 401/175 |
| 1,907,376 | 5/1933 | Weck | 401/175 |
| 2,565,346 | 8/1951 | Braselton | 401/63 X |
| 2,595,635 | 5/1952 | Braselton | 401/75 |
| 2,612,990 | 10/1952 | Braselton | 401/87 |
| 3,082,869 | 3/1963 | Bau | 401/63 |
| 3,191,768 | 6/1965 | Davis | 401/63 |
| 4,363,560 | 12/1982 | Gentile | 401/68 |

FOREIGN PATENT DOCUMENTS

| | | | |
|---|---|---|---|
| 2 096 440 | 5/1992 | Canada . | |
| 387 213 | 9/1990 | European Pat. Off. . | |
| 617 904 | 10/1994 | European Pat. Off. . | |
| 1118520 | 6/1956 | France | 401/DIG. 1 |
| 1283961 | 1/1962 | France | 401/175 |
| 1289874 | 2/1962 | France | 401/175 |
| 2 142 832 | 2/1973 | France . | |
| 41 16 581 | 5/1992 | Germany . | |
| 42 23 871 | 8/1993 | Germany . | |

*Primary Examiner*—Steven A. Bratlie

*Attorney, Agent, or Firm*—Wayne C. Jaeschke; Frank E. Robbins; Thomas P. Hilliard

[57] ABSTRACT

A container (1) for applying a spreadable product (4) such as an adhesive, having an inner tube (3) that is removably mounted in an outer tube (5). A piston-like plunger (12) is disposed in the inner tube (3) and is moveable axially within the inner tube (3), for moving the spreadable material therein to a position projecting from the tubes, for application to a surface. A removable closure cap is provided to enclose the spreadable material within the two tubes.

24 Claims, 7 Drawing Sheets

REFILLABLE CONTAINER FOR APPLYING A SPREADABLE PRODUCT, MORE PARTICULARLY AN ADHESIVE COMPOUND

FIELD OF THE INVENTION

This invention relates to a container for applying a spreadable product, more particularly an adhesive, comprising an inner tube open at at least one end which contains the spreadable product, which is removably mounted in an outer tube and which comprises a plunger designed to be penetrated by a screwthreaded spindle and means for securing the inner tube in the outer tube. The screwthreaded spindle and the plunger form cooperating means for applying the spreadable product. By rotation of the screwthreaded spindle, which engages in a screwthread formed within the plunger, by means of an actuating element arranged outside the outer tube, more particularly a hand-operated knurled nut, the spreadable product can be longitudinally displaced inside the container with no change in the positions of the outer and inner tubes relative to one another.

BACKGROUND OF THE INVENTION

A refillable container in the form of a refill cartridge for adhesive sticks is known from DE 41 16 581 A1. The reusable outer tube comprises a screwthreaded spindle which rotates on rotation of a knurled nut arranged at the closed end of the container. The replaceable part, i.e. the inner tube, comprises the plunger with the internal screwthread in which the screwthreaded spindle engages to displace the plunger towards the open end of the tubular container opposite the knurled nut and hence to push out the adhesive from the open end.

The known container is in the form of a refill container for an adhesive stick intended for use on paper. The following procedure is adopted to refill the container. The knurled nut is rotated until it no longer engages in the internal screwthread of the plunger. The empty inner tube is then withdrawn from the outer tube together with the plunger. A new inner tube filled with the adhesive and comprising a plunger with a central screwthreaded bore is then introduced into the open end of the outer tube until the upper end of the screwthreaded spindle fixedly connected to the outer tube comes into contact with the internal screwthread of the plunger. By turning the knurled nut, the screwthreaded spindle is screwed into the internal screwthread of the plunger and into the adhesive. At the same time, the inner tube continues moving into the outer tube until it reaches its final position in which nipples arranged on the inner wall of the outer tube snap into correspondingly shaped depressions in the outer wall of the inner tube. The inner tube is thus fixed inside the outer tube so that the inner tube cannot be longitudinally displaced or rotated relative to the outer tube. To remove the adhesive, the knurled nut is then rotated in the opposite direction so that the plunger moves towards the open end of the inner tube and pushes out the adhesive.

The disadvantage of the known container lies in the time-consuming screwing movement involved in the fitting of a new refill cartridge. Accordingly, the user is often not prepared to fit a new refill cartridge to the empty container, instead the container as a whole is discarded and a new complete container is used instead. This means that the purpose of the known container, namely to reduce waste, is often not fulfilled.

Accordingly, the problem addressed by the present invention was considerably to simplify replacement of the inner tube in a container of the type mentioned at the beginning.

SUMMARY OF THE INVENTION

According to the invention, the solution to this problem is characterized in that the screwthreaded spindle is rotatably fixed to the inner tube in a position in which it penetrates through the plunger and comprises a connecting part which, in particular, projects from the inner tube and which is designed to be releasably, but non-rotatably coupled to a corresponding connecting part of the actuating element.

In contrast to the cited prior art, therefore, the screwthreaded spindle is not part of the outer tube, but rather part of the inner tube and, hence, the part to be replaced. Accordingly, there is no need for any screwing movement when the empty inner tube is replaced by a new inner tube filled with the spreadable product. It is sufficient after removing the empty inner tube to introduce the new inner tube into the outer tube until the connecting parts of the outer and inner tubes are connected to one another.

This very simple and quick replacement of the inner tube leads to a considerable reduction in the amount of waste although the part to be replaced, i.e. the non-reusable part, contains more material than in the prior art. This is because, by virtue of the simplified replacement of the inner tube, the user will no longer discard the entire container with the outer and inner tubes as a whole.

To reduce the amount of waste, the inner tube advantageously has a thin wall. To this end, it is proposed that the inner tube should have a wall thickness of 0.1 to 1 mm and, more particularly, 0.3 to 0.8 mm. This reduced wall thickness of the inner tube has the further advantage that the useful space left in the inner tube for filling with the spreadable product is particularly large.

The releasable non-rotatable connection of the inner tube to the outer tube may assume various forms. In one advantageous embodiment, the connecting part arranged on the inner tube projects from the inner tube and has a cross-sectional area variable longitudinally of the inner tube. These features can be found in the second embodiment of the invention described hereinafter with reference to FIGS. 3 to 5 of the accompanying drawings.

In another preferred embodiment of the invention, the fixing means are formed by at least one resiliently flexible lip directed away from the open end. The lip arranged on the inner tube, which may also be referred to as a flap, is used for the releasable, non-rotatable connection of the inner tube to the outer tube. A corresponding embodiment is described in more detail hereinafter with reference to FIGS. 10 and 11 of the accompanying drawings. Where several'such lips projecting from the inner tube are provided, they may act as feet for the inner tube to stand on, thus facilitating filling of the inner tube with the spreadable product by the manufacturer.

In another preferred embodiment of the invention, the plunger comprises an inner part with the internal screwthread for the screwthreaded spindle and an outer part which is arranged circularly around the inner part and which is designed for displacement relative thereto longitudinally of the inner tube. In addition, means are provided to limit the longitudinal displacement of the outer part on the outer wall of the outer part and the inner wall of the inner tube at the open end thereof. When virtually all the spreadable product has been used up, the outer part of the plunger comes into contact with the limiting means on the inner wall of the inner tube. On further rotation of the screwthreaded spindle, the inner part of the plunger is pressed out beyond the edge of the outer part so that even the final traces of the spreadable product are forced out from the inner tube. A corresponding embodiment is described in more detail hereinafter with reference to FIGS. 7 to 9.

In another embodiment of the invention, the connecting parts of the inner tube and the actuating element are designed to be non-rotatably interconnected for axial displacement relative to one another. One connecting part may be formed, for example, by a square pin while the other connecting part may be an opening with a corresponding square cross-section.

Finally, another embodiment of the invention is characterized by a longitudinally displaceable pusher which acts on the inner tube and which is guided outwards through the actuating element. The pusher facilitates removal of the empty inner tube. To this end, pressure is applied to the outwardly projecting part of the pusher so that the inner tube separates from the outer tube and is moved towards the open end thereof. A corresponding embodiment of the invention is described in detail hereinafter with reference to FIGS. 10 to 12.

BRIEF DESCRIPTION OF THE DRAWINGS

Embodiments of the invention are described in detail in the following with reference to the accompanying drawings, wherein.

DETAILED DESCRIPTION OF THE INVENTION

Figure 1:
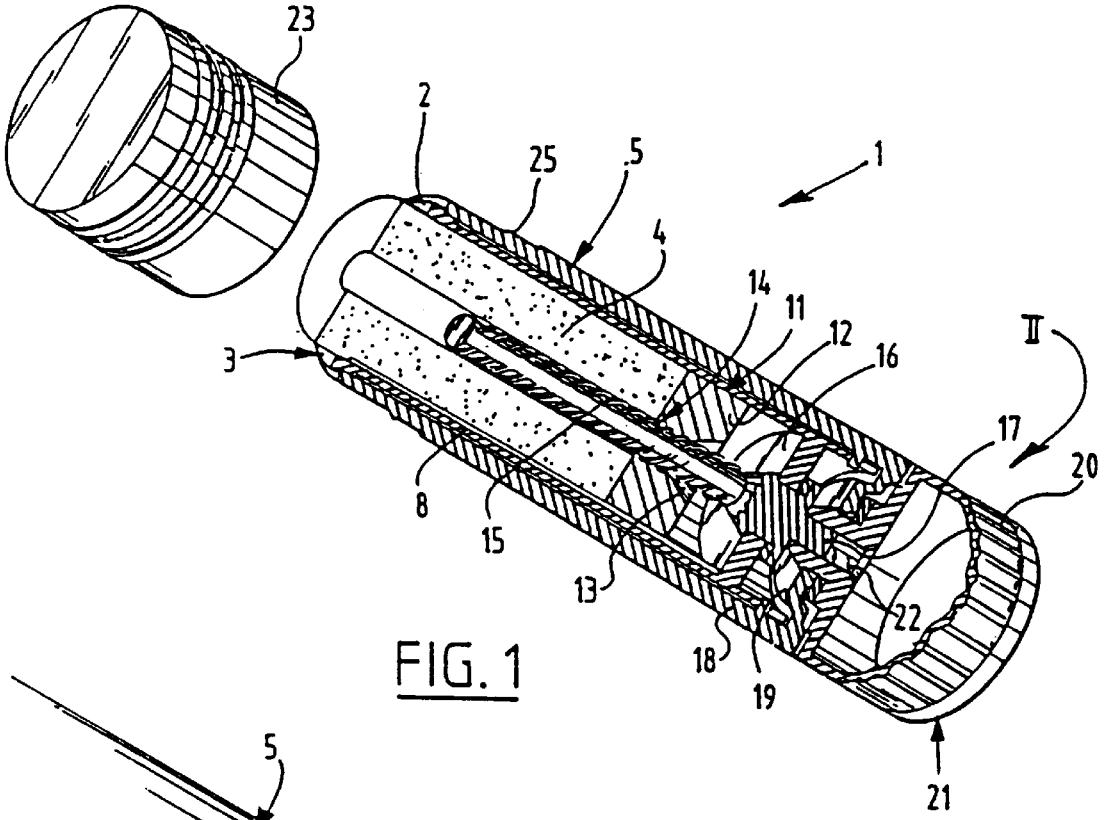
FIG. 1 is a perspective view, partly in section, of a first embodiment of the container.

In the Figures, the same elements have been denoted by the same reference numerals.

The container globally denoted by the reference 1 in the drawing comprises an inner tube 3—open at one end 2—with a spreadable product 4, more particularly an adhesive, and an outer tube 5 which at least partly surrounds the inner tube 3.

Figure 2:
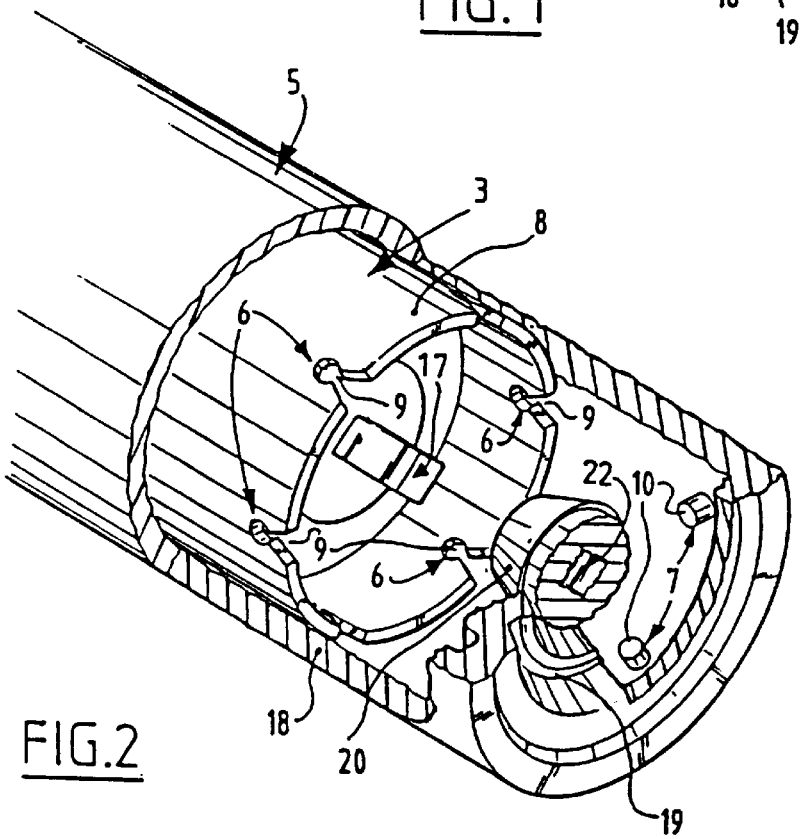
FIG. 2 is a perspective view, partly in section, in the direction of arrow II in FIG. 1.

The inner tube 3 is fixed in the outer tube 5 by fixing means 6 arranged therein which, in the assembled state of the container 1, cooperate with holding means 7 of the outer tube 5. In the embodiment shown in FIGS. 1 and 2, the fixing means 6 consist of keyhole-like apertures 9 in the lower edge of the inner tube wall 8 while the holding means 7 consist of pins 10 on the inner wall of the outer tube 5. The pins 10 and the apertures 9 form a releasable snap-action fastening when the inner tube 3 is fully inserted into the outer tube 5.

Arranged in the inner tube 3 are axially displaceable means 11 for the measured application of the product 4. These means 11 are in the form of a plunger 12 which fits narrowly into the inner tube 3 and which is designed to slide axially along the inner wall of the inner tube 3, being formed with a central screwthreaded bore 13.

In addition, the inner tube 3 serving as a refill container comprises drive means 14 connected to the means 11. In the illustrated embodiments, the drive means 14 are formed by a screwthreaded spindle 15 which is mounted for rotation about its longitudinal axis in the bottom 16 of the inner tube 3. The drive means 14 or rather the screwthreaded spindle 15 comprises a connecting part 17 which projects from the bottom 16 of the inner tube and which can be reached from the outside of the inner tube 3. The connecting part 17 has at least one corner edge on its circumference parallel to the longitudinal axis of the screwthreaded spindle 15. In the embodiment shown in FIGS. 1 and 2, the connecting part 17 is in the form of a rod-like square.

The outer tube 5 consists of a housing 18 which surrounds the inner tube 3. An actuating element 21 which cooperates with the connecting part 17 of the inner tube 3 or rather the screwthreaded spindle 15 is mounted for rotation in the bottom 19 of the outer tube 5 in an opening formed coaxially of the screwthreaded spindle 15. The actuating element 21 is a hand-operated knurled nut 20. The wall thickness of the housing 18 is selected so that it is far more rigid than the wall 8 of the inner tube 3 serving as refill container. Accordingly, the housing 18 is able to absorb the actuating forces applied to the container 1.

In the middle of its side facing the outer tube 5 and the inner tube 3, the hand-operated knurled nut 20 comprises a raised connecting part which is coaxial with the screwthreaded spindle 15 and which is formed with an aperture 22 complementary to the connecting part 17 of the inner tube 3 or rather the screwthreaded spindle 15. The connecting part of the knurled nut 20 is guided through the opening in the bottom 19 of the outer tube 5 and engages behind the bottom 19 on the inside of the tube, so that the hand-operated knurled nut 20 is rotatably fixed to the bottom 19. When the inner tube 3 has been inserted into the outer tube 5, the connecting part 17 of the screwthreaded spindle 15 engages in the aperture 22 or rather in the opening of the connecting part of the knurled nut 20 so that the screwthreaded spindle 15 is, or can be, coupled in this way to the knurled nut 20. A geometric design of the aperture 22 and the connecting part 17 which prevents the connecting part 17 from slipping in the aperture 22 on rotation of the knurled nut 20 guarantees that, when the knurled nut 20 is rotated, the screwthreaded spindle 15 rotates so that the plunger 12 is moved towards the open end 2 of the inner tube 3. The inner tube 3 is fixed to the outer tube by the fixing means 6 and 7 so that the inner and outer tubes do not move relative to one another when the knurled nut 20 is rotated. Only the plunger 12 is moved relative to the tubes 3 and 5. The plunger is moved up or down in the inner tube 3, depending on the direction of rotation of the knurled nut 20. The spreadable product is moved by the plunger and, when the knurled nut 20 is correspondingly actuated, emerges from the container 1 in measured amounts.

Figure 7:
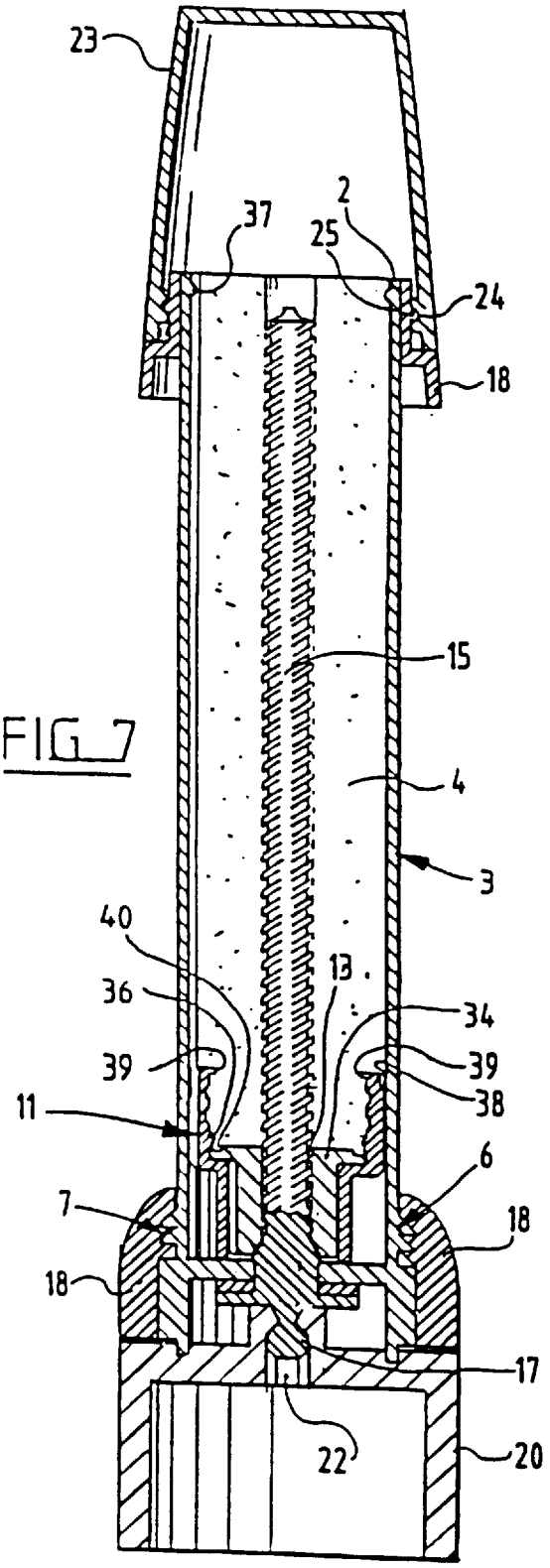
FIG. 7 is a section on line VII—VII in FIG. 6.

To protect the spreadable product from drying out, a closure cap 23 is designed to be fitted onto the outer tube 5. The closure cap 23 comprises fixing means 24 (see FIGS. 7 and 11) which are formed internally on the wall of the closure cap and which, when the closure cap 23 is fitted onto the outer tube 5, form a snap-action coupling with complementary fixing means 25 formed on the outer tube 5.

The use of the first embodiment of the container according to the invention is described in the following. The container 5 supplied to a consumer normally has an inner tube 3 filled with the spreadable product 4. After removal of the closure cap 23, the spreadable product 4 can be removed by the user turning the knurled nut 20 relative to the container 1 so that the plunger 12 forces the spreadable product out of the container 1 so that the spreadable product 4, for example adhesive, lip cream or the like, can be applied to a surface to be treated.

When the spreadable product 4 has been used up, i.e. when the inner tube 3 is empty, the inner tube 3 may simply be removed from the container 1 or rather the outer tube 5 by withdrawal therefrom. The snap-action connection formed by the pins 10 and the keyhole-like openings 9 is designed in such a way that the inner tube 3 can be removed relatively simply from the outer tube 5. The part to be replaced consists of the inner tube 3, the plunger 12, the screwthreaded spindle 15 and the connecting part 17. After removal of the inner tube 3 with the parts connected thereto, a refill container in the form of a new inner tube 3 may be inserted into the container 1 or rather into the outer tube 5 and snap-fixed therein so that the container 1 is ready to be reused.

The relatively simple replacement of the inner tube 3, which takes very little time, facilitates the use of the container 1 with the inner tubes 3 as a refill container. The repeated use of the container 1 consisting of the outer tube 5 and the hand-operated knurled nut 20 reduces the consumption of raw materials and the amount of waste ensuing therefrom. In order further to reduce the material of the replacement part, the inner tube 3 intended as a refill container is made with very thin walls, i.e. it has wall thicknesses of 0.1 to 1 mm and preferably 0.3 to 0.8 mm. The screwthreaded spindle 15 can also be made relatively thin so that the amount of material involved in the refill container 3 is relatively small.

The small dimensions of the wall 8 of the inner tube 3 and the screwthreaded spindle 15 have the further advantage that the useful space left in the inner tube 3 or rather the outer tube 5 for filling with the spreadable product 4 is particularly large.

Because the user is more inclined to use the container 1 several times because it is easier to refill than in the case of the refill system described in the preamble to the present specification, the overall consumption of material is reduced in relation to the known refill system although the screwthreaded spindle is also replaced in the refill system according to the invention.

Figure 5:
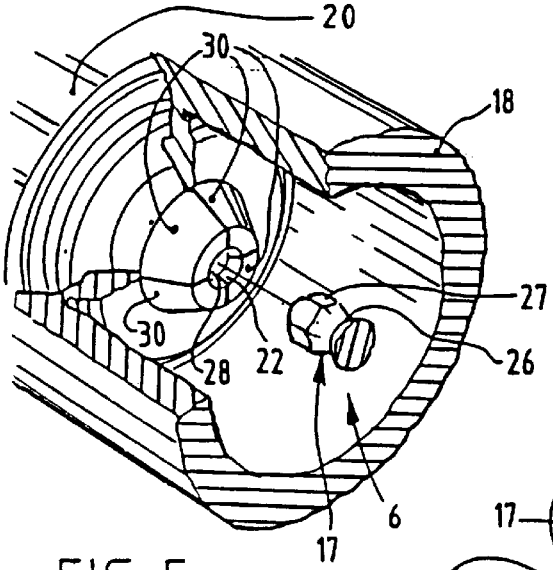
FIG. 5 is a partly broken view in the direction of arrow V in FIG. 3.
Figure 4:
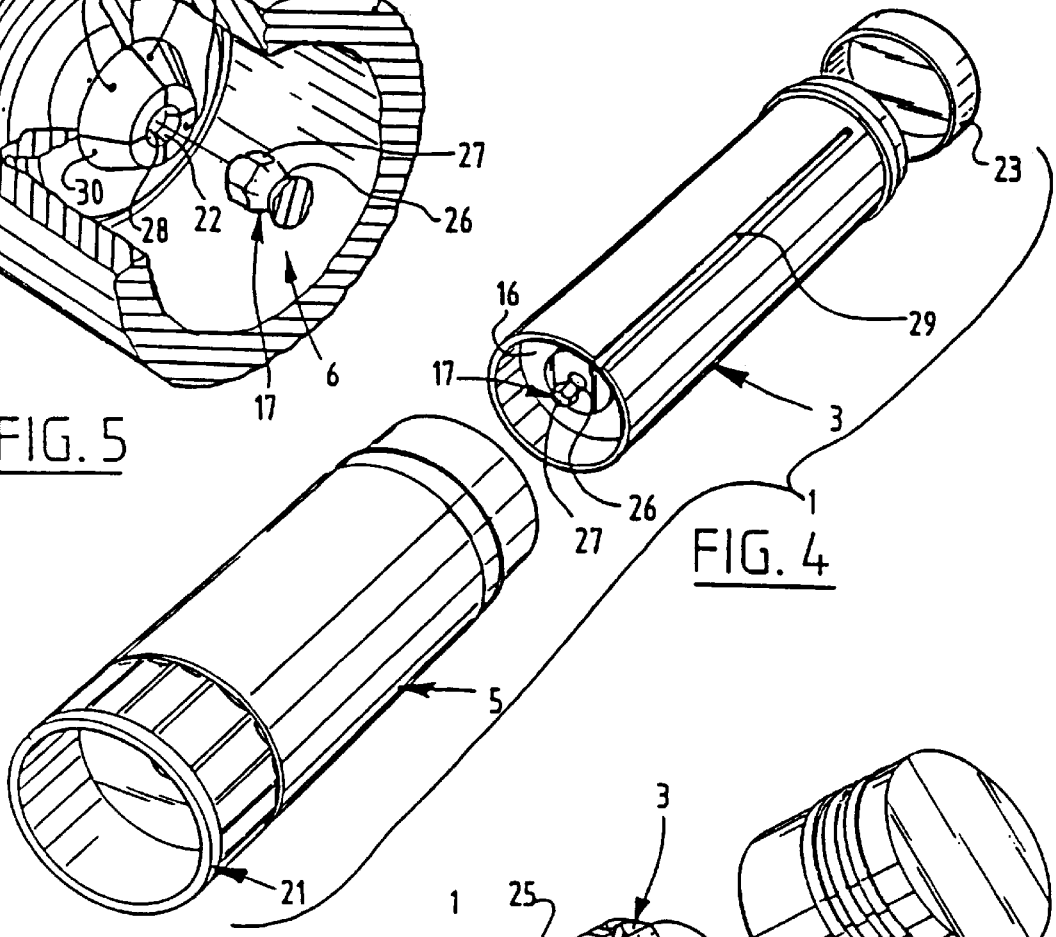
FIG. 4 is a perspective view of the outer tube and inner tube of the container shown in FIG. 3 before they are fitted together.
Figure 3:
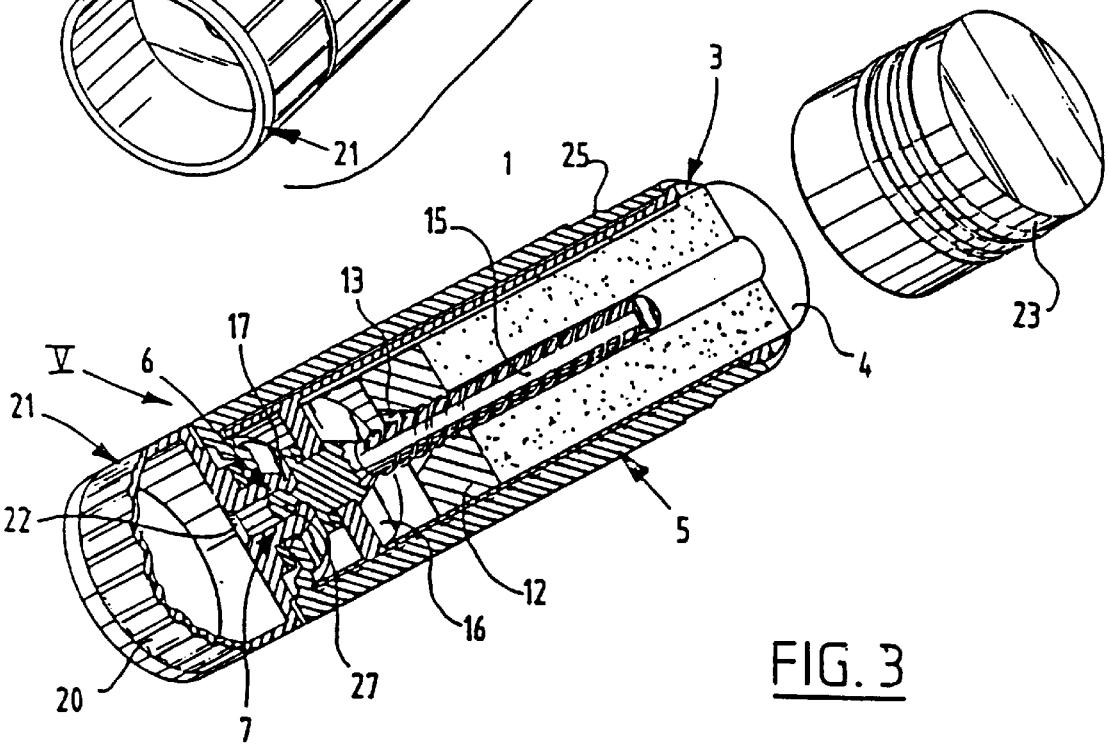
FIG. 3 is a perspective view, partly in section, of a second embodiment of the container.
Figure 6:
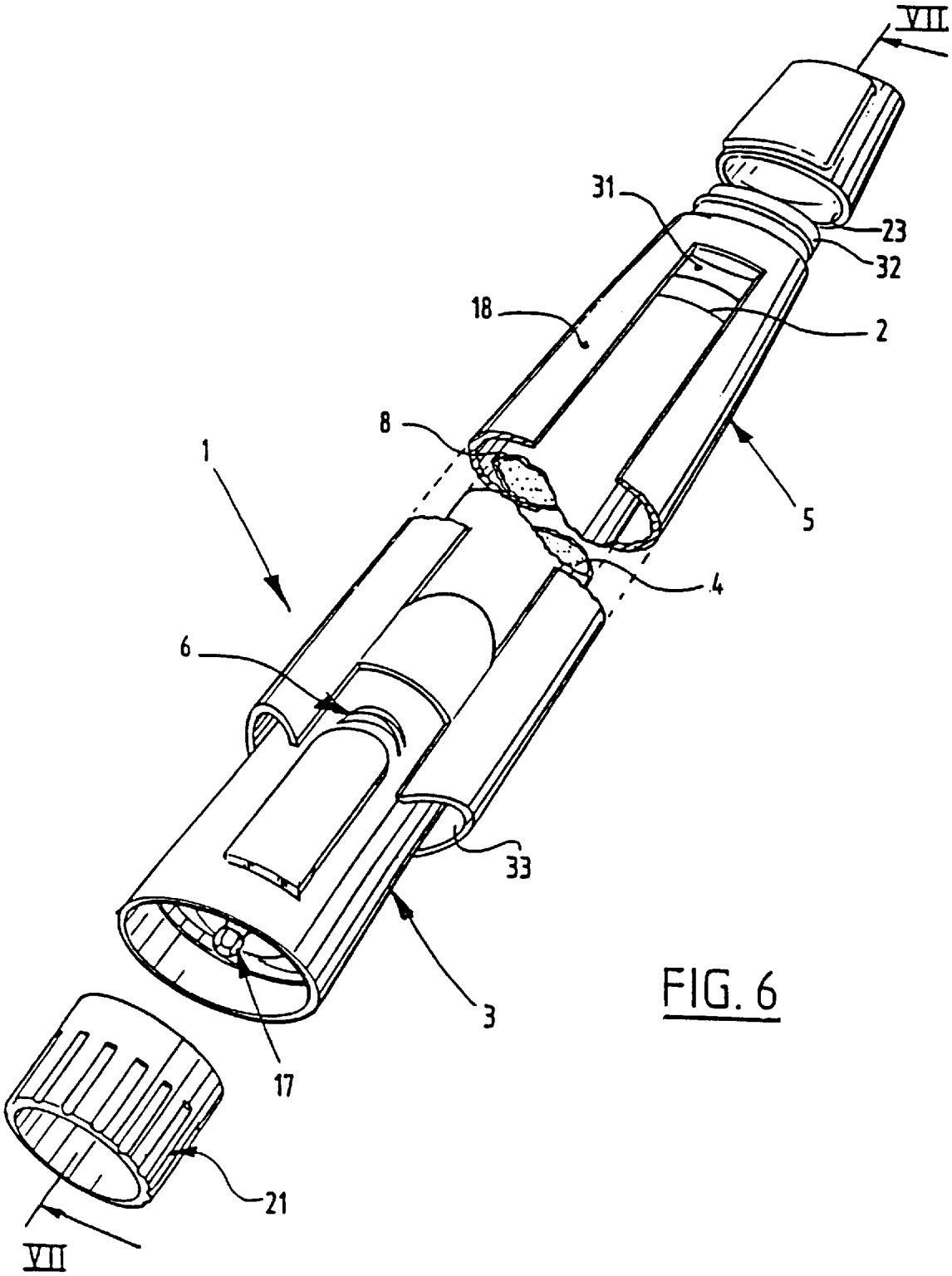
FIG. 6 is a partly broken view of a third embodiment.

In the second embodiment of the container shown in FIGS. 3 to 5, the fixing means 6 and the connecting part 17 of the inner tube 3 are integral, i.e. form a single element. The connecting part 17 varies in its cross-section longitudinally of the screwthreaded spindle 15 with a constricted part 26 and an adjoining knob 27. The aperture 22 is complementary in shape to the connecting part 17. In the vicinity of the opening 28, the aperture 22 is provided with an undercut-like constriction which engages in the region 26 of the connecting part 17. In the case of the connecting part formed on the knurled nut 20, this constriction is formed by mutually opposite, elastically movable lips 30.

In this embodiment, the inner tube 3 is secured in the outer tube 5 by pushing the inner tube 3 into the housing 18 of the outer tube 5 until the connecting part 17 snaps into the aperture 22 of the connecting part of the knurled nut 20. The inner tube 3 is thus fixed in the outer tube 5 by the elastically movable lips 30 engaging firmly behind the knob 27 of the connecting part 17.

To stop the inner tube 3 from rotating inside the outer tube 5, the inner tube 3 is provided with a number of longitudinal ribs 29 which cooperate with cams or fillets (not shown) arranged on the inside of the outer tube 5. These elements, which are shown in FIG. 4, are also present in the embodiment shown in FIGS. 1 and 2. In addition, the inner tube 3 is provided with a closure cap 23*a* in FIG. 4. The unit consisting of the inner tube 3 and the closure cap 23*a* may readily be marketed as a refill unit separately from the container consisting of the outer tube 5 with the knurled nut 20.

It can also be seen from FIG. 4 that the wall 8 of the inner tube 3 extends beyond the connecting part 17 projecting from the base 16, so that the inner tube 3 can be placed in a very stable upright position. Filling of the inner tube 3 with the spreadable product 4 during the production process is considerably simplified in this way.

FIGS. 6 to 9 show a third embodiment of the container 1 in which the wall 18 of the outer tube 5 has openings 31. The filling level of the inner tube 3 can be seen through the openings 31 when the inner tube 3 is made of a transparent plastic.

In addition, the outer tube 5 differs from the preceding embodiments in that it is open on two sides. The dimensions of the outlet opening 32 are smaller than the diameter of the inner tube 3, so that a feed opening 33 is formed in the side opposite the outlet opening 32 for the insertion of the inner tube 3 into the outer tube 5. In this embodiment, therefore, the actuating element 21 or rather the knurled nut is removably arranged on the outer tube 5. The fixing means 6 and the holding means 7 of the inner tube 3 and the outer tube 5 assume the form of a bead and groove or interengaging ribs.

The inner tube 3 is pushed downwards into the outer tube 5 until the fixing means 6 and the holding means 7 snap into one another. The knurled nut 20 or rather the actuating element 21, which comprises the aperture 22 cooperating with the connecting part 17, is then pushed onto the connecting part 17 so that the container 1 is ready for use.

To remove the inner tube 3 from the outer tube 5, the knurled nut 20 is removed from the connecting part 17 and the interlocking connection between the fixing means 6 and the holding means 7 is released by gently compressing the wall 18 of the outer tube 5 parallel to the fixing means so that the inner tube 3 can be removed from the outer tube 5.

In the embodiment illustrated in FIGS. 6 to 9, the plunger 12 is formed by two separable parts 34 and 35 arranged concentrically to one another. The inner part 34 has an opening 13 with an internal screwthread and, in its starting position, is held fast behind an inwardly projecting edge 36 of the outer part 35.

Figure 8:
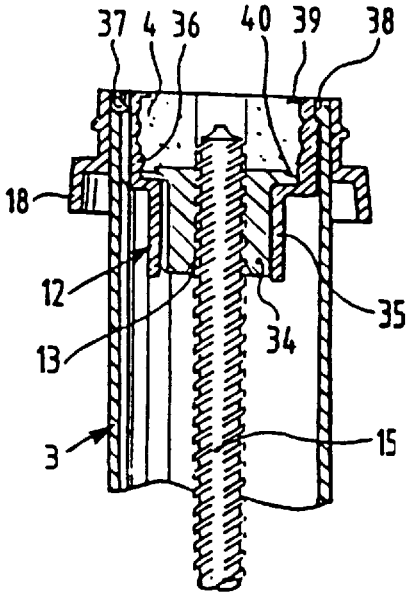
FIG. 8 is a view of the plunger shown in FIG. 7 in its first end position.

In this position of the two parts 34 and 35 relative to one another, the plunger 12 is moved into the end position shown in FIG. 8. Towards its open end 2, the inner tube 3 comprises means 37 for limiting the displacement of the plunger 12 beyond the position shown in FIG. 8. The means 37 are formed by an encircling bead arranged on the inside of the upper, outer edge of the inner tube 3. When the spreadable product 4 has been used up apart from the residue shown in FIG. 8, the edge 38 of the outer part 35 of the plunger 12 comes into contact with the limiting means 37 of the inner tube 3.

If, now, the knurled nut 20 and hence the screwthreaded spindle 15 are further actuated, the inner part 34 of the plunger 12 is pushed out beyond the edge 36 of the outer part 35, so that the last remains of the spreadable product 4 are also forced out from the plunger 12. The outer part 35 is provided on its upper side with means 39 for limiting the movement of the inner part 34 in the form of an inwardly projecting bead. The inner part 34 is provided with an aperture 40 or a peripherally encircling groove which cooperates with this bead. On reaching its end position shown in FIG. 9, the inner part 34 forms a flat upper surface with the outer part 35 of the plunger 12, so that the plunger 12 is completely freed from spreadable product 4.

Figure 9:
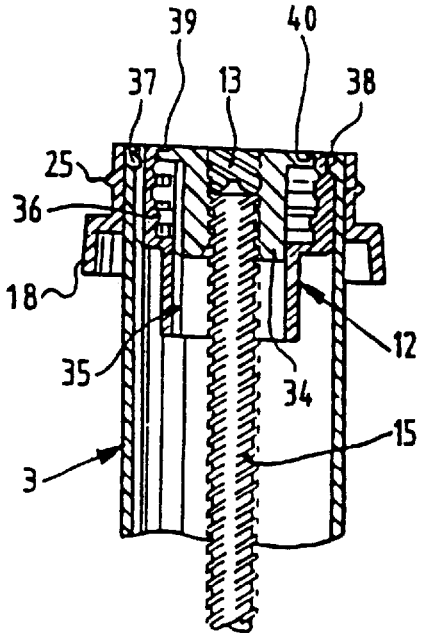
FIG. 9 is a view of the plunger corresponding to FIG. 8 in its second end position.

The illustrated means 37 for limiting the movement of the plunger 12 may of course also be provided in the first and second embodiments of the invention. In this case, the effect of further actuation of the screwthreaded spindle 15 when the plunger has reached the end position shown in FIG. 9 is that the inner tube 3 is pushed out from the outer tube 5 by release of the snap-action connection with the outer tube 5 and the knurled nut 20. The limiting means 39 of the plunger 12 consisting of the parts 34 and 35 also have a similar effect where they are present in a container corresponding to the first or second embodiment.

Each of the illustrated embodiments described in the foregoing shows a projecting connecting part 17 of the drive means 14 and a receiving aperture 22 of the actuating element 20. The connecting part 17 of the drive means 14 may of course also be provided with an aperture, i.e. may serve as the receiving part, while a correspondingly shaped connecting part engaging positively in the connecting part 17 of the inner tube 3 is provided on the upper surface of the actuating element 21 or rather the knurled nut 20.

Figure 10:
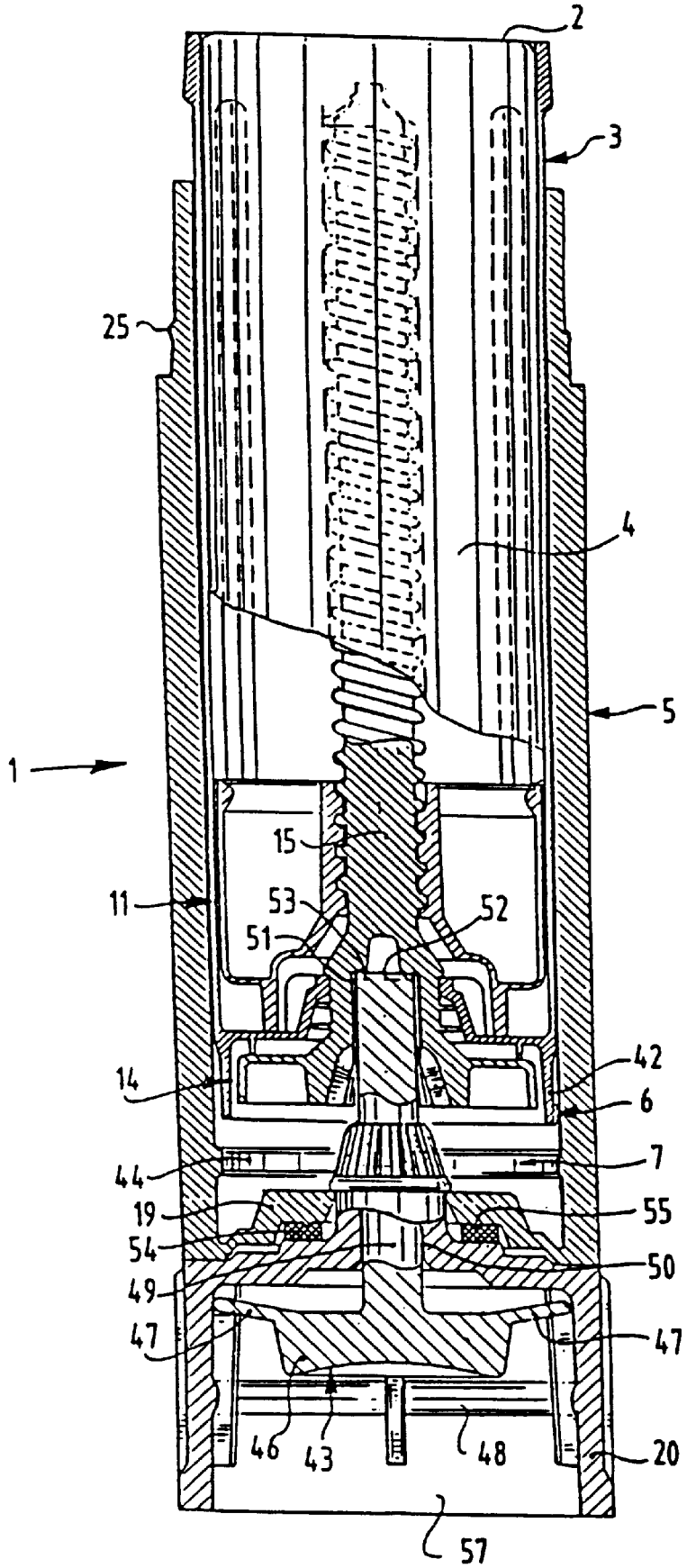
FIGS. 10 and 11 are longitudinal sections through a fourth embodiment before and after assembly.
Figure 11:
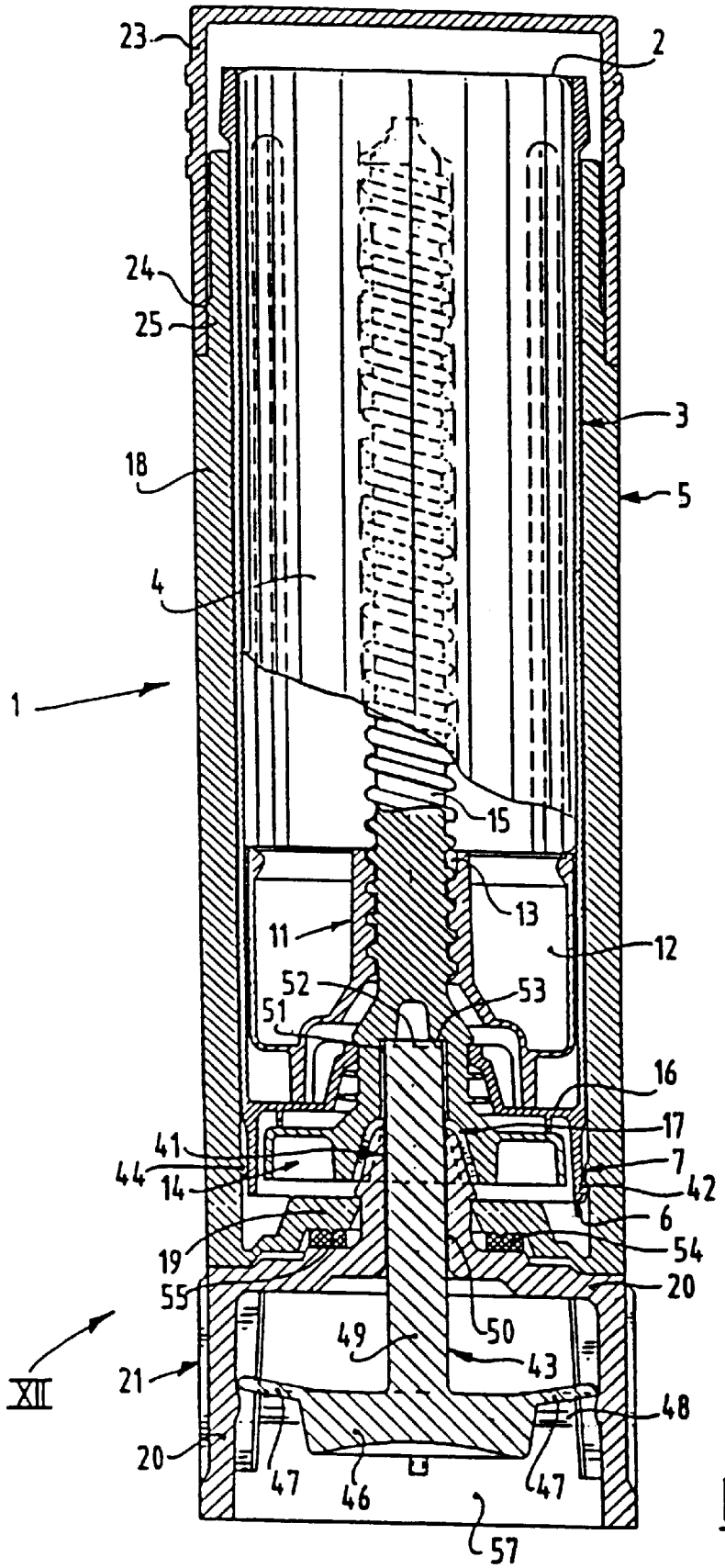
Figure 12:
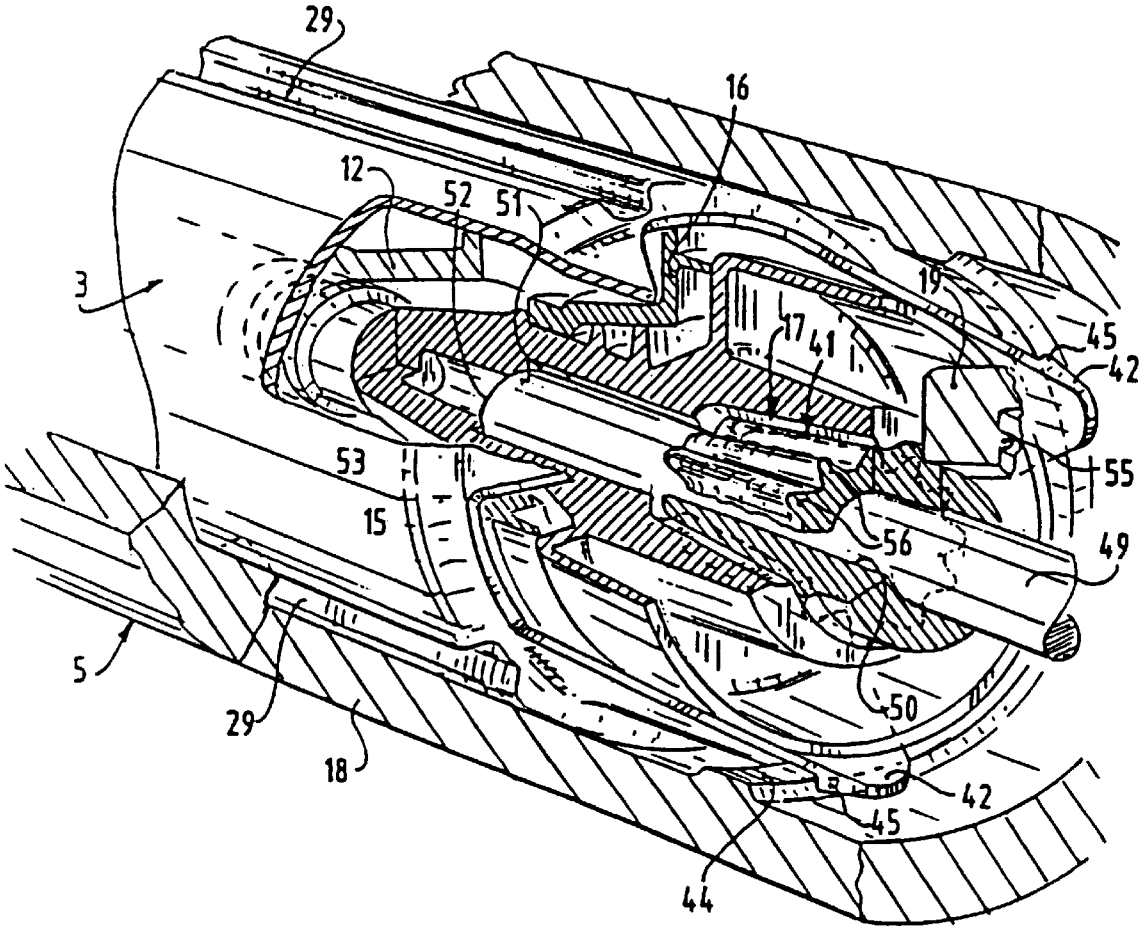
FIG. 12 is a partly broken perspective view in the direction of arrow XII in FIG. 11.

One such embodiment is illustrated in FIGS. 10 to 12 as a fourth embodiment of the invention. The projecting connecting part 41 of the knurled nut 20 engages positively in the connecting part 17 of the screwthreaded spindle 15.

In the embodiment shown in FIGS. 10 to 12, the projecting connecting part 41 of the knurled nut 20 has a star-like cross-section with a plurality of ribs 56 while the connecting part 17 has a corresponding star-like aperture. In this fourth embodiment, a few flexible lips 42 arranged on the underneath of the inner tube 3 are provided as fixing means 6. The lips 42 are uniformly distributed over the periphery of the lower edge of the inner tube 3, beyond which they slightly project. The inner tube 3 is thus able to stand vertically on the lips 42 while it is being filled with spreadable product 4. The lips 42 are provided with projections 45 which, when the inner tube 3 is inserted in the outer tube 5, flexibly engage an encircling fillet 44 formed internally on the inner wall of the outer tube 5 at the lower end thereof to form a snap-action connection.

The outer tube 5, which is connected to the knurled nut 20 by means of the connecting part 41 through a hole in its base 19, further comprises an ejector element 43 guided for longitudinal displacement in an opening 50 of the knurled nut 20. The ejector element 43 consists of a push button 46, a number of elastic arms 47 arranged peripherally on the push button 46 and a pusher element 49. The push button 46 and the arms 47 are accommodated for longitudinal displacement in an inner space 57 of the knurled nut 20. The pusher element 49 extends through the opening 50 of the knurled nut 20 and through the projecting connecting part 41.

At its lower end adjoining the space of the connecting means 17 accommodating the connecting part 41, the screwthreaded spindle 15, comprises a space 51 which accommodates the pusher element 49. The space 51 is provided at its end with an encircling shoulder 53, against which the end 52 of the pusher element 49 strikes, as shown in FIGS. 10 and 11.

When the inner tube 3 is inserted into the outer tube 5, the shoulder 53 comes into contact with the end face 52 of the pusher element so that, after the inner tube 3 has been fully inserted into its end position inside the outer tube 5, the ejector element 43 is brought into the starting position shown in FIG. 11. Just before the lips 42 of the inner tube 3 engage behind the fillet 44 of the outer tube 5, the arms 47 of the ejector element 43 come into contact with an encircling fillet 48 formed on the inside of the inner space 57 of the knurled nut 20. The inner tube 3 is moved into the outer tube 5 until the lips 42 engage with their projections 45 behind the fillet or the bead 44, so that the arms 47 of the ejector element 43, which bear against the fillet 48, are easily deflected so that a pressure is applied to the shoulder 53 of the screwthreaded spindle 15 via the end face 52 of the pusher element 49. The inner tube 3 is thus held under bias in the outer tube 5 so that, despite production inaccuracies, the inner tube 3 and the outer tube 5 are unable to move relative to one another in the event of shaking of the container 1.

In order to enable the hand-operated knurled nut 20 to rotate satisfactorily relative to the housing 18 or rather the outer tube 5 under the conditions of this bias, a bearing or slip ring 54 is provided between the knurled nut 20 and the bottom 19 of the outer tube 5. This bearing or slip ring 54 is radially fixed by means of an annular bead 55 projecting from the base 19 of the housing 18.

When the spreadable product 4 accommodated in the inner tube 3 has been used up, the plunger 12 is positioned at the upper edge-of the inner tube 3 at its open end 2. If pressure is applied to the push button 46 in this position, the screwthreaded spindle 15 mounted in the base 16 of the inner tube 3 is pushed towards the open end 2, the lips 42 being released from their snap-action connection and the inner tube 3 projecting slightly from the outer tube 5. The inner tube 3 is now easy to grip and withdraw from the outer tube 5. The outer tube 5 can then be refilled by insertion of a new inner tube 3.

In all the embodiments illustrated, the inner tube 3 has a wall 8 which extends over the entire axial length of the spreadable product 4. In another possible embodiment, however, the inner tube 3 merely has a base 16 and walls extending over a short length or height therefrom. The height or rather depth of the inner tube 3 need be no greater than the plunger 12 accommodated therein so that the molded stick of spreadable product extending over the length of the outer tube 5 is sufficiently anchored and supported during its upward and downward movements in the container 1.

We claim:

1. A container for applying a spreadable product, comprising:

an inner tube open at at least one end which contains the spreadable product which is removably mounted in an outer tube and which comprises a plunger designed to be penetrated by a screwthreaded spindle and fixing members for securing the inner tube in the outer tube, the screwthreaded spindle and the plunger forming cooperating elements for applying the spreadable product and the spreadable product being longitudinally displaceable inside the container with no change in the positions of the outer and inner tubes relative to one another through rotation of the screwthreaded spindle, which engages in a screwthread formed within the plunger, by an actuating element, more particularly a hand-operated knurled nut, arranged outside the outer tube characterized in that the screwthreaded spindle is rotatably fixed to the inner tube in a position in which it penetrates through the plunger and comprises a connecting part which, in particular, projects from the inner tube and which is designed to be releasably, but not-rotatably coupled to a corresponding connecting part of the actuating element.

2. A container as claimed in claim 1, characterized in that the inner tube has wall thickness of 0.1 to 1 mm.

3. A container as claimed in claim 1, characterized in that the connecting part arranged on the screwthreaded spindle projects from the inner tube and has a cross-sectional area variable longitudinally of the inner tube.

4. A container as claimed in claim 1, characterized in that the fixing members include a plurality of resiliently flexible lips which are directed away from the open end and which in particular project away from the inner tube toward the actuating element.

5. A container as claimed in claim 1, characterized in that the plunger comprises an inner part with the internal screwthread for the screwthreaded spindle and an outer part which is arranged circularly around the inner part and which his designed for displacement relative thereto longitudinally of the inner tube and in that means for limiting the longitudinal displacement of the outer part are provided on the outer wall of the outer part and the inner wall of the inner tube in the region of its open end.

6. A container as claimed in claim 1, characterized in that the connecting parts of the screwthreaded spindle and the actuating element are designed to be non-rotatably interconnected for axial displacement relative to one another, the connecting part of the actuating element includes a generally cone-shaped member with opposed, inclined surfaces which converge towards each other in the direction towards the plunger and the actuating element of the screwthreaded spindle includes an aperture which mates with the cone-shaped member and the aperture has opposed, inclined surfaces which converge towards each other in the direction towards the plunger.

7. A container as claimed in claim 1, characterized by a longitudinally displaceable pusher which acts on the inner tube and which is guided outwards through the actuating element.

8. A container as claimed in claim 3, characterized in that the fixing members include at least one resiliently flexible lip which is directed away from the open end and which in particular projects from the inner tube.

9. A container as claimed in claim 8, characterized in that the plunger comprises an inner part with the internal screwthread for the screwthreaded spindle and an outer part which is arranged circularly around the inner part and which is designed for displacement relative thereto longitudinally of the inner tube and in that means for limiting the longitudinal displacement of the outer part are provided on the outer wall of the outer part and the inner wall of the inner tube in the region of its open end.

10. A container as claimed in claim 4, characterized in that the plunger comprises an inner part with the internal screwthread for the screwthreaded spindle and an outer part which is arranged circularly around the inner part and which is designed for displacement relative thereto longitudinally of the inner tube and in that means for limiting the longitudinal displacement of the outer part are provided on the outer wall of the outer part and the inner wall of the inner tube in the region of its open end.

11. A container as claimed in claim 10, characterized in that the connecting parts of the inner tube and the actuating element are designed to be non-rotatably interconnected for axial displacement relative to one another.

12. A container as claimed in claim 11, characterized by a longitudinally displaceable pusher which acts on the inner tube and which is guided outwards through the actuating element.

13. A container as claimed in claim 1, characterized in that the actuating element is a hand-operated knurled nut.

14. A container for applying a spreadable product open at at least one end which can contain the spreadable product, which is removably mounted in an outer tube and which comprises a plunger designed to be penetrated by a screwthreaded spindle and fixing members for securing the inner tube in the outer tube, the screwthreaded spindle and the plunger forming cooperating elements for applying the spreadable product and the spreadable product being longitudinally displaceable inside the container with no change in the positions of the outer and inner tubes relative to one another through rotation of the screwthreaded spindle, which engages in a screwthread formed within the plunger, by an actuating element, arranged outside the outer tube, characterized in that the screwthreaded spindle is rotatably fixed to the inner tube in a position in which it penetrates through the plunger and comprises a connecting part which, in particular, projects from the inner tube and which is designed to be releasably, but non-rotatably coupled to a corresponding connecting part of the actuating element; and characterized in that the connecting part arranged on the screwthreaded spindle projects from the inner tube and has a cross-sectional area variable longitudinally of the inner tube.

15. A container as claimed in claim 14, characterized in that the fixing members include a plurality of resiliently flexible lips which are directed away from the open end and which in particular project away from the inner tube toward the actuating element.

16. A container as claimed in claim 14, characterized in that the connecting parts of the screwthreaded spindle and the actuating element are designed to be non-rotatably interconnected for axial displacement relative to one another, the connecting part of the actuating element includes a generally cone-shaped member with opposed, inclined surfaces which converge towards each other in the direction towards the plunger and the actuating element of the screwthreaded spindle includes an aperture which mates with the cone-shaped member and the aperture has opposed, inclined surfaces which converge towards each other in the direction towards the plunger.

17. A container as claimed in claim 15, characterized in that the plunger comprises an inner part with the internal screwthread for the screwthreaded spindle and an outer part which is arranged circularly around the inner part and which is designed for displacement relative thereto longitudinally of the inner tube and in that means for limiting the longitudinal displacement of the outer part are provided on the outer wall of the outer part and the inner wall of the inner tube in the region of its open end;

characterized in that the connecting parts of the inner tube and the actuating element are designed to be non-rotatably interconnected for axial displacement relative to one another; and characterized by a longitudinally displaceable pusher which acts on the inner tube and which is guided outwards through the actuating element.

18. A container as claimed in claim 15, characterized in that the plunger comprises an inner part with the internal screwthread for the screwthreaded spindle and an outer part which is arranged circularly around the inner part and which is designed for displacement relative thereto longitudinally of the inner tube and in that means for limiting the longitudinal displacement of the outer part are provided on the outer wall of the outer part and the inner wall of the inner tube in the region of its open end.

19. A container as claimed in claim 18, characterized in that the connecting parts of the inner tube and the actuating element are designed to be non-rotatably interconnected for axial displacement relative to one another.

20. A container as claimed in claim 14, characterized in that the plunger comprises an inner part with the internal screwthread for the screwthreaded spindle and an outer part which is arranged circularly around the inner part and which is designed for displacement relative thereto longitudinally of inner tube and in that means for limiting the longitudinal displacement of the outer part are provided on the outer wall of the outer part and the inner wall of the inner tube in the region of its open end.

21. A container as claimed in claim 14, characterized by a longitudinally displaceable pusher which acts on the inner tube and which is guided outwards through the actuating element.

22. A container as claimed in claim 14, characterized in that the actuating element is a hand-operated knurled nut.

23. A container for applying a spreadable product, comprising:

an inner tube open at at least one end which contains the spreadable product, which is removably mounted in an outer tube and which comprises a plunger designed to be penetrated by a screwthreaded spindle and fixing members for securing the inner tube in the outer tube, the screwthreaded spindle and the plunger forming cooperating elements for applying the spreadable product and the spreadable product being longitudinally displaceable inside the container with no change in the positions of the outer and inner tubes relative to one another through rotation of the screwthreaded spindle, which engages in a screwthread formed within the plunger, by an actuating element, arranged outside the outer tube, characterized in that the screwthreaded spindle is rotatably fixed to the inner tube in a position in which it penetrates through the plunger and comprises a connecting part which, in particular, projects from the inner tube and which is designed to be releasably, but not-rotatably coupled to a corresponding connecting part of the actuating element, the actuating element including a longitudinally displaceable pusher having a pusher element extending completely through the connecting part of the actuating element and into direct contact with the screwthreaded spindle.

24. A container as claimed in claim 23, wherein the screwthreaded spindle has a recess, which is open towards the actuating element and closed towards the plunger, and the pusher element extends within the recess of the screwthreaded spindle while remaining removable from the recess.

* * * * *

UNITED STATES PATENT AND TRADEMARK OFFICE

CERTIFICATE OF CORRECTION

PATENT NO. : 6,089,774
DATED : July 18, 2000
INVENTOR(S) : Franken et al.

It is certified that error appears in the above-identified patent and that said Letters Patent is hereby corrected as shown below:

Column 8,
Line 57, after "which", insert -- , --.

Column 9,
Lines 1 and 2, after "element", delete ", more particularly a hand-operated knurled nut".
Line 3, after "tube" insert -- , --.

Signed and Sealed this

Fourteenth Day of October, 2003

JAMES E. ROGAN
*Director of the United States Patent and Trademark Office*